US005928784A

United States Patent [19]

Sugihara et al.

[11] Patent Number: 5,928,784

[45] Date of Patent: Jul. 27, 1999

[54] POLYVINYL ALCOHOL FIBER CONTAINING TOURMALINE PARTICLES

[75] Inventors: Toshio Sugihara, Tokyo-to; Siro Nakamura, Nagoya; Marcos Masaki Komiya, Tokyo-to; Tadayoshi Utsumi, Shizuoka-ken; Ichiro Nagashima, Fujieda, all of Japan

[73] Assignees: Life Energy Industry Inc.; Nitivy Company Limited; Fuji Lace Sangyo Co., Ltd., all of, Japan

[21] Appl. No.: 08/842,517

[22] Filed: Apr. 24, 1997

[51] Int. Cl.[6] ..... D02G 3/00

[52] U.S. Cl. ..... 428/372; 55/DIG. 39

[58] Field of Search ..... 428/312, 196; 55/DIG. 39; 442/375, 417, 205; 521/32, 33

[56] References Cited

U.S. PATENT DOCUMENTS 4,125,486 11/1978 Uzumaki et al. ..... 521/32

4,264,676 4/1981 Uzumaki et al. ..... 428/401

5,744,222 4/1998 Sugihara ..... 428/196

5,787,525 8/1998 Sugihara ..... 5/421

*Primary Examiner*—Newton Edwards

*Attorney, Agent, or Firm*—Wenderoth, Lind & Ponack, L.L.P.

[57] ABSTRACT

Proposed is an electret fiber which is an insolubilized polyvinyl alcohol fiber containing 0.05 to 0.5% by weight of tourmaline particles having a particle diameter not exceeding 0.3 μm. The electret fiber is effective for invigoration of human body by promoting blood circulation and also effective for decreasing the BOD value of sewage water by activating the bacteria in the activated sludge. The electret fiber is prepared by spinning a spinning solution of the polyvinyl alcohol containing the tourmaline particles into the form of a fiber which is then subjected to an insolubilization treatment by a heat treatment, formalization with formaldehyde or acetalization with glutaraldehyde.

4 Claims, 4 Drawing Sheets

POLYVINYL ALCOHOL FIBER CONTAINING TOURMALINE PARTICLES

BACKGROUND OF THE INVENTION

The present invention relates to a novel fibrous material which is a polyvinyl alcohol fiber containing fine particles of tourmaline and to a method for the preparation thereof. More particularly, the invention relates to a polyvinyl alcohol fiber capable of emitting active ions to exhibit an effect of invigoration or activation of living body cells and an effect of activating the microorganisms in an activated sludge in the disposal of sewage water by the activated sludge method.

It is an issue of interest in recent years that living body cells can be activated by so-called active ions to improve the healthful condition of the living body so that various studies are now under way to utilize active ions for the control of autonomic and motorial nervous systems, promotion of sound sleep, ataractic stabilization, acceleration of recovery from fatigue and so on.

As one of the substances which emit such active ions, tourmaline, which is a naturally occurring mineral but can be synthesized artificially, is proposed as promising. Namely, tourmaline is the strongest in the permanent spontaneous electric polarizability among known electret minerals having permanent polarizability so that the vector of polarization thereof is not influenced by an external electric field. It is also noted that the tourmaline mineral emits far-infrared light which, according to recent reports, has effects for the quality improvement of water, preservation of fresh foods, quality improvement of foods, growth promotion of plants and so on as well as for the promotion of blood circulation and acceleration of metabolism in living bodies.

One of the inventors has proposed, directing his attention to these facts, tourmaline-containing electret fibers in Japanese Patent Publication 6-104926 after extensive investigations on the beneficial effects such as improvement of blood circulation on a person wearing clothes or athletic supporters made from a fabric of certain fibers containing fine particles of tourmaline.

SUMMARY OF THE INVENTION

The present invention accordingly has an object to provide a novel tourmaline-containing electret fiber capable of emitting active ions in a greatly improved high efficiency and useful not only for the purpose of activation of living body cells but also for the purpose of sewage disposal as well as an efficient method for the preparation thereof.

Thus, the electret fiber provided by the invention is an insolubilized fiber of polyvinyl alcohol containing from 0.01 to 3% by weight or, preferably, from 0.05 to 0.5% by weight, based on the amount of the polyvinyl alcohol, of particles of tourmaline having a particle diameter not exceeding 0.3 $\mu$m uniformly dispersed in the fiber.

The above defined polyvinyl alcohol-based insolubilized electret fiber of the invention is prepared by a method which comprises the steps of:

(a) dissolving a polyvinyl alcohol in water to form an aqueous spinning solution;

(b) uniformly dispersing particles of tourmaline having a particle diameter not exceeding 0.3 $\mu$m in the aqueous spinning solution in an amount in the range from 0.05 to 0.5% by weight based on the amount of the polyvinyl alcohol;

(c) spinning the tourmaline-containing spinning solution of polyvinyl alcohol into the form of a tourmaline-containing fiber; and (d) subjecting the tourmaline-containing fiber to an insolubilization treatment.

The invention further provides a method for promoting digestion of organic matter contained in sewage water which comprises the step of: bringing the sewage water into contact with an insolubilized fiber of polyvinyl alcohol containing from 0.05 to 0.5% by weight, based on the amount of the polyvinyl alcohol, of particles of tourmaline having a particle diameter not exceeding 0.3 $\mu$m uniformly dispersed in the fiber.

DETAILED DESCRIPTION OF THE PREFERRED EMBODIMENTS

Figure 1:
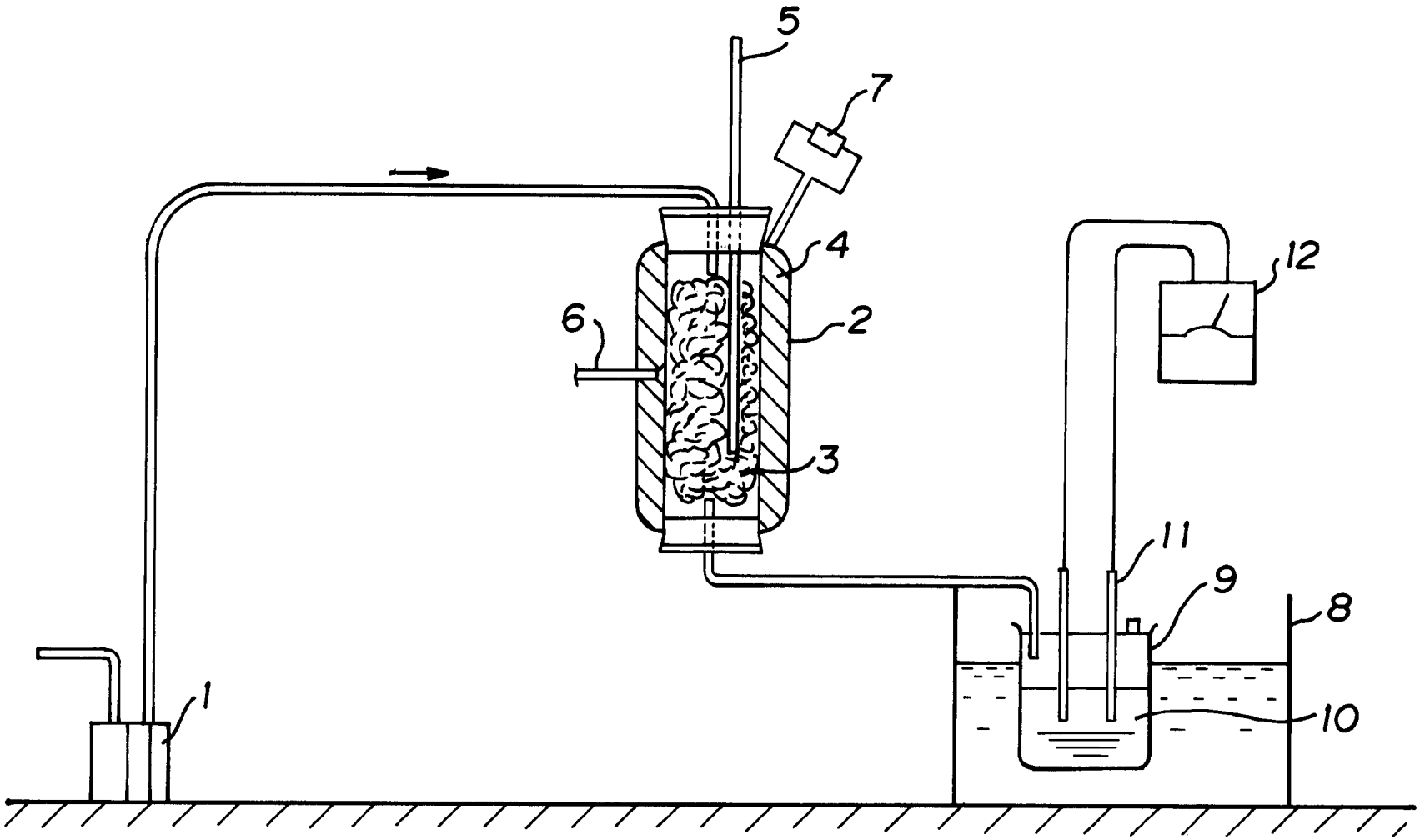
FIG. 1 is a schematic illustration of the system for the measurement of active ion emission from the electret fibers.

As is described above, the electret fiber of the invention is an insolubilized polyvinyl alcohol fiber containing particles of tourmaline having a specified particle size and uniformly dispersed in the fiber body in a specified amount.

Namely, the particles of tourmaline in the inventive electret fiber should have a particle diameter not exceeding 0.3 $\mu$m or, preferably, not exceeding 0.2 $\mu$m. The amount of the tourmaline particles dispersed in the polyvinyl alcohol fiber is in the range from 0.05 to 0.5% by weight based on the amount of the polyvinyl alcohol fiber. When these requirements are satisfied, the tourmaline-containing polyvinyl alcohol fibers of the invention are useful for the purpose of living body invigoration and sewage disposal in which, when the tourmaline-containing fibers in the form of a bioreactor brought into contact with the sewage water by filtration, exhibit excellent effect of immobilization of the bacteria in activated sludges lastingly without being damaged by the microorganisms in the sewage water. Presumably, the growth or multiplication of the bacteria in activated sludges can be promoted by the active ions emitted from the tourmaline particles contained in the inventive polyvinyl alcohol fibers. As is known, polyvinyl alcohol fibers have excellent weather-ability and are highly resistant against ultraviolet light of the sun light when the fibers are used as a material of nets and ropes for fishing and cultivation of sea organisms as well as outdoor clothes. Fine particles of tourmaline can be obtained by the method of water-granulation or water-pulverization to have a particle diameter as small as 0.1 $\mu$m or even smaller. Such fine particles of tourmaline can be dispersed easily and uniformly in the spinning solution of polyvinyl alcohol.

Tourmaline, which is dispersed in the polyvinyl alcohol-based fibers in the form of fine particles, is a kind of naturally occurring minerals and has a chemical composition expressed by the general formula $$MX_3B_3Al_3\ (AlSi_2O_9)_3\ (O,OH,F)_4,$$

in which M is an atom of sodium or calcium and X is an atom of aluminum, iron, lithium, magnesium or manganese.

Tourmaline of high purity having good transparency is known as a gem stone and methods for the preparation of artificial single crystals of tourmaline have been developed. In the present invention, the origin of the tourmaline is not particularly limitative and natural and artificial tourmaline crystals can be used equally. Tourmaline is susceptible to spontaneous permanent electric polarization without influences on the vector of polarization by an external electric field. The permanent polarization of tourmaline is the strongest among minerals. It is also known that tourmaline emits far infrared light. Further, tourmaline is susceptible to the piezoelectric effect which is a phenomenon that a dielectric polarization is induced in an ionic crystal under application of a stress by an external force and also susceptible to the pyroelectric effect which is a phenomenon of appearance of electric charges on the surface of the crystal when the crystal is locally heated. It is also an established fact that anionic active ions are emitted from fibers containing fine particles of tourmaline dispersed therein.

The effect of active ion emission from tourmaline is greatly enhanced when the mineral is in the form of extremely fine particles. In this regard, the tourmaline particles used in the invention should have a particle diameter not exceeding 0.3 μm or, preferably, not exceeding 0.2 μm with an average particle diameter not exceeding 0.1 μm. The amount of the tourmaline particles contained in the polyvinyl alcohol fibers is in the range from 0.01 to 3% by weight or, preferably, from 0.05 to 0.5% by weight based on the amount of the polyvinyl alcohol from the standpoint of obtaining a good balance between the active ion emission and the cost. When the amount of the tourmaline particles is too small, active ion emission would be too low as a matter of course while an increase in the amount of the tourmaline particles to exceed the above mentioned upper limit has no particular additional advantages rather with an economical disadvantage due to an increase in the costs.

It is optional that the tourmaline-containing polyvinyl alcohol fiber of the invention further contains fine particles of other inorganic or ceramic materials emitting far infrared light including alumina, silicate minerals such as cordierite and β-spodumene, zirconia, zircon, magnesia, aluminum titanate and the like as well as transition metal compounds such as manganese dioxide, iron oxide, chromium oxide, cobalt oxide and copper oxide, silicon nitride, silicon carbide and the like.

The principal constituent of the inventive tourmaline-containing fiber is a polyvinyl alcohol which is not particularly limitative and can be freely selected from commercial polyvinyl alcohol products available on the market. Preferably, however, the polyvinyl alcohol should be a completely saponified one having a degree of saponification of 99% or higher and should have an average degree of polymerization in the range from 1000 to 2000.

It is essential that the polyvinyl alcohol fiber containing tourmaline particles is insolubilized in order to be imparted with increased water resistance and heat resistance. Unexpectedly, the insolubilization treatment of the tourmaline-containing polyvinyl alcohol fiber has an additional advantage of an increase in the active ion emission therefrom. The method for the insolubilization of the polyvinyl alcohol fiber can be a heat treatment or acetalization treatment, i.e. formalization with formaldehyde or glutalization with glutaraldehyde, or a combination of heat treatment and acetalization in which, usually, the acetalization treatment follows the heat treatment.

Following is a description of a preferred embodiment of the method for the preparation of the inventive tourmaline-containing insolubilized polyvinyl alcohol fiber.

In the first place, tourmaline is finely pulverized into particles having a particle diameter not exceeding 0.3 μm or, preferably, not exceeding 0.2 μm. The method for the pulverization of tourmaline is not particularly limitative including dry-process and wet-process methods, of which the wet-process method by using water as the medium is preferred in respect of the efficiency. One or more of optional inorganic or ceramic materials mentioned above can be pulverized together with tourmaline in the wet-process pulverization procedure to give an aqueous dispersion of the particles having a particle diameter not exceeding 0.3 μm or, preferably, not exceeding 0.2 μm.

A spinning solution for spinning of polyvinyl alcohol fibers having an appropriate concentration of the polyvinyl alcohol and an appropriate consistency suitable for spinning is prepared by dissolving an appropriate amount of a polyvinyl alcohol having a degree of saponification of at least 99% and an average degree of polymerization of 1000 to 2000 in the thus obtained aqueous dispersion of the tourmaline particles along with addition of an additional amount of water, if necessary. The spinning solution can be admixed, if desired, with an appropriate amount of an antibacterial or antifungal agent and a deodorant.

Spinning of the thus prepared spinning solution is performed either in a wet-spinning or dry-spinning method, of which the dry-spinning method is preferred. When the dry-spinning method is undertaken, a spinning solution containing a polyvinyl alcohol in a concentration of 30 to 40% by weight is extruded through holes of a spinnerette into an atmosphere of hot air at 160 to 200° C. into the form of filaments which are as such subjected to a hot-stretching treatment. When the insolubilization treatment of the polyvinyl alcohol fiber is performed by a heat treatment, the thus obtained tourmaline-containing filaments are subjected to a heat treatment at a temperature in the range from 210 to 240° C. to give a tourmaline-containing insolubilized polyvinyl alcohol fiber.

When the insolubilization treatment of the tourmaline-containing polyvinyl alcohol fiber is performed by formalization, the tourmaline-containing filaments are immersed in an aqueous formalizing bath containing sodium sulfate, sulfuric acid and formaldehyde each in an appropriate concentration at a temperature of 40 to 70° C. to give a tourmaline-containing formalized polyvinyl alcohol fiber.

When the acetalization treatment for insolubilization of the tourmaline-containing polyvinyl alcohol filaments is performed with glutaraldehyde, the tourmaline-containing filaments are immersed in an aqueous acetalizing bath containing sodium sulfate, sulfuric acid and glutaraldehyde each in an appropriate concentration at a temperature of 30 to 60° C. to give a tourmaline-containing acetalized polyvinyl alcohol fiber.

In the following, description is given to illustrate the tourmaline-containing polyvinyl alcohol fiber and the method for the preparation thereof as well as applications thereof in more detail by way of examples although the scope of the present invention is never limited thereby in any way.

EXAMPLE 1

Tourmaline-containing insolubilized polyvinyl alcohol fibers were prepared in the following manner. Thus, 100 parts by weight of a polyvinyl alcohol having a degree of saponification of at least 99% and an average degree of polymerization of 1200 were added to an aqueous dispersion containing 0.05, 0.125, 0.25, 1.0, 3.0, 4.8 or 11.0 parts by weight of tourmaline particles having a particle diameter not exceeding 0.3 μm and an average particle diameter of 0.2 μm. A 34 parts by weight portion of each of these blends was admixed with 66 parts by weight of deionized water and kneaded together in a kneader at an elevated temperature to give a tourmaline-containing spinning solution having a viscosity of 340 to 420 poise at 80° C. and containing from 34.0 to 34.5% by weight of the polyvinyl alcohol.

The thus prepared spinning solution was subjected to dry spinning by extrusion through a spinnerette having 30 holes of 0.09 mm diameter into a hot air atmosphere at 180° C. to form filaments which were immediately subjected to hot stretching by 450% followed by a heat treatment at 225° C. for 2 to 3 seconds. The tourmaline-containing polyvinyl alcohol fibers thus obtained had a fineness of 120 to 125 denier/30 filaments, dry strength of 3.2 to 3.6 g/d, dry elongation of 12 to 16% and softening point in water of 82 to 87° C.

The tourmaline-containing polyvinyl alcohol fibers were subjected to the test for emission of active ions in the following manner by using the testing assembly schematically illustrated in FIG. 1 of the accompanying drawing. In the testing assembly, a sample holder 2 was filled with 20 g of the sample fibers in the form of a wadding bed 3 which was thermostatted at 37° C. under monitoring on a thermometer 5 with a mantle heater 4 such as a ceramic heater connected to a power supply source 7 controlled by means of a temperature sensor 6. An air blower pump 1 was operated to introduce clean decarbonated air into the top of the wadding bed 3 at a rate of 100 ml/minute. The air passing through the wadding bed 3 and discharged out of the bottom of the sample holder 2 was led to a glass beaker 9 and blown at the surface of deionized water 10 kept at 21° C. in a thermostat 8 and having an electric conductivity of 1.7 μS/cm at 21° C. A pair of platinum electrodes 11, 11 and a conductivity meter 12 (Precision LCR Meter Model 4285A, manufactured by Hewlett Packard Co.) served to detect the electric conductivity of the water 10 in the beaker 9. After continued running in the above described manner for 3 hours, the electric conductivity of the water 10 in the beaker 9 was recorded to give the results graphically shown by the curve A in FIG. 2 as a function of the content of the tourmaline particles in the fibers.

EXAMPLE 2

Tourmaline-containing polyvinyl alcohol fibers insolubilized by formalization were prepared in the following manner. Thus, the polyvinyl alcohol fibers prepared in Example 1 after the heat treatment containing tourmaline particles in different contents were dipped for 2 hours at 60° C. in a formalizing solution consisting of 4% by weight of formaldehyde, 20% by weight of sulfuric acid, 20% by weight of sodium sulfate and 56% by weight of water in a bath ratio of 1:4. The thus obtained formalized polyvinyl alcohol fibers had a degree of formalization of 38 to 40%, dry strength of 2.6 to 3.1 g/d, dry elongation of 18 to 23% and softening point in water of 109 to 112° C.

The above obtained formalized polyvinyl alcohol fibers containing tourmaline particles in different contents were subjected to the active ion emission test in the same manner as in Example 1 to record the electric conductivity of the water 10 after 3 hours of continued air blowing. The results are shown by the curve B in FIG. 2 as a function of the content of the tourmaline particles in the fibers.

EXAMPLE 3

Tourmaline-containing polyvinyl alcohol fibers insolubilized by acetalization with glutaraldehyde were prepared in the following manner. Thus, the polyvinyl alcohol fibers prepared in Example 1 after the heat treatment containing tourmaline particles in different contents were dipped for 1 hour at 40° C. in an acetalizing solution consisting of 0.5% by weight of glutaraldehyde, 20% by weight of sulfuric acid, 15% by weight of sodium sulfate and 64.5% by weight of water in a bath ratio of 1:3. The thus obtained acetalized polyvinyl alcohol fibers had a dry strength of 1.9 to 2.3 g/d, dry elongation of 9 to 13% and softening point in water of 109 to 115° C.

The above obtained acetalized polyvinyl alcohol fibers containing tourmaline particles in different contents were subjected to the active ion emission test in the same manner as in Example 1 to record the electric conductivity of the water 10 after 3 hours of continued air blowing. The results are shown by the curve C in FIG. 2 as a function of the content of the tourmaline particles in the fibers.

Figure 2:
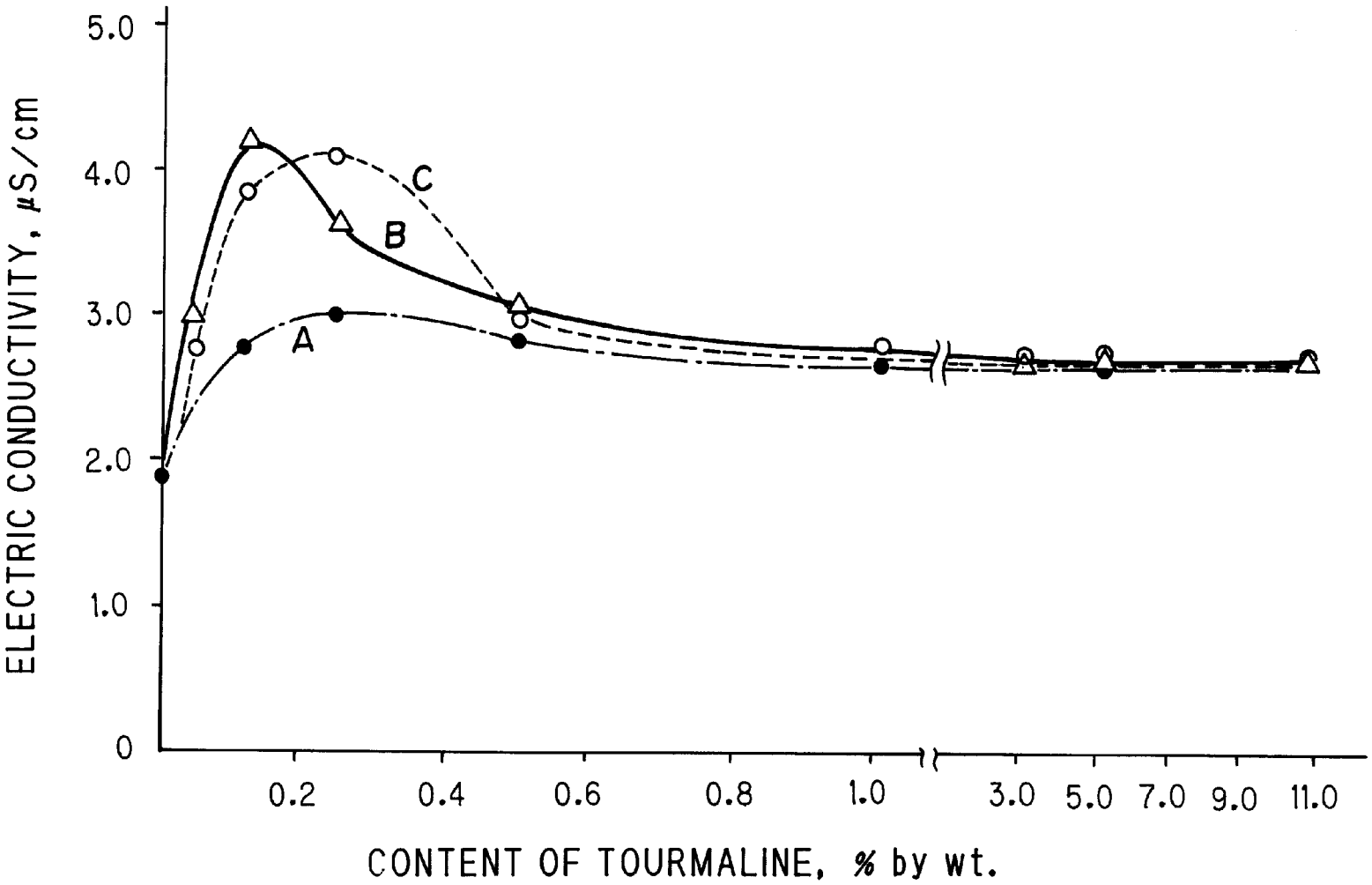
FIG. 2 is a graph showing the electric conductivity of the water capturing the active ions emitted from the electret fibers prepared in the Examples by using the apparatus shown in FIG. 1 as a function of the content of tourmaline particles in the fibers.

The results obtained in Examples 1 to 3 and shown in FIG. 2 indicate that the efficiency of active ion emission from the tourmaline-containing polyvinyl alcohol fibers can be enhanced by the formalization or acetalization of the heat-treated fibers and the improvement is somewhat greater by the formalization than by the acetalization with glutaraldehyde. Further, it is a quite unexpected discovery that the efficiency of active ion emission has a maximum value with a content of tourmaline particles in the range from 0.05 to 0.5% by weight decreasing when the amount of the tourmaline particles is further increased and levels off when the tourmaline content is increased beyond 0.5% by weight.

An electron microscopic examination was undertaken for the formalized polyvinyl alcohol fibers containing 0.25% by weight and 4.8% by weight of the tourmaline particles as prepared in Example 2 described above. Thus, each of the fibers was examined on a high-resolution transmission electron microscope (Model JEM-200CX, manufactured by Nippon Denshi Co.) with an electron acceleration voltage of 160 kV to find that the tourmaline particles in the fiber of 0.25% tourmaline content had a particle diameter of mostly 0.1 μm or smaller ranging in a range from 0.02 to 0.2 μm and were in a uniformly and discretely dispersed state while the particles in the fiber of 4.8% tourmaline content were mostly in the form of agglomerates of primary particles having a diameter of 0.1 μm or smaller, most of the agglomerates having a diameter in the range from 0.2 to 1.8 μm. This result may explain the unusual phenomenon shown by the curves in FIG. 2 that the efficiency of active ion emission has a maximum with a tourmaline content in the range from 0.05 to 0.5% by weight as a consequence of the state of uniform and discrete dispersion of the particles when the tourmaline content in the fiber is low while the particles are in an agglomerated state when the tourmaline content in the fiber is high.

APPLICATION EXAMPLE 1

The influence of the tourmaline-containing polyvinyl alcohol fibers on human bodies was tested by the thermographic measurement of the skin temperature. Thermography is a technique for detecting and measuring variation or distribution in the heat emitted from various regions of the living body by using a high-sensitivity infrared camera and transforming the infrared radiation into visible signals that can be recorded in a ten-fold colored photography showing the temperature distribution.

Thus, two bedding mats were prepared, one, from the formalized polyvinyl alcohol fibers containing 0.25% by weight of tourmaline particles as prepared in Example 2 and, the other, from conventional formalized polyvinyl alcohol fibers containing no tourmaline particles. Thermographic measurement of the skin temperature distribution was undertaken for two healthy adult men as the subjects respectively lying in a face-up position on the above mentioned two bedding mats to find a temperature increase by about 1.0° C. in the skin temperature of legs of the subject lying on the tourmaline-containing mat indicating promotion of the subcutaneous blood circulation not only during lying on the mat but also for some length of time after he left the mat while substantially no variations could be detected in the skin temperature of the subject lying on the mat without tourmaline particles.

The above described results support the conclusion that tourmaline-containing polyvinyl alcohol fibers have an effect to promote the subcutaneous blood circulation in human body resulting in an increase in the skin temperature and the testing method of active ion emission by the measurement of the electric conductivity of water with injection of the active ions can be a measure for the estimation of the living-cell invigorating effect by the tourmaline-containing polyvinyl alcohol fibers.

APPLICATION EXAMPLE 2

Figure 3:
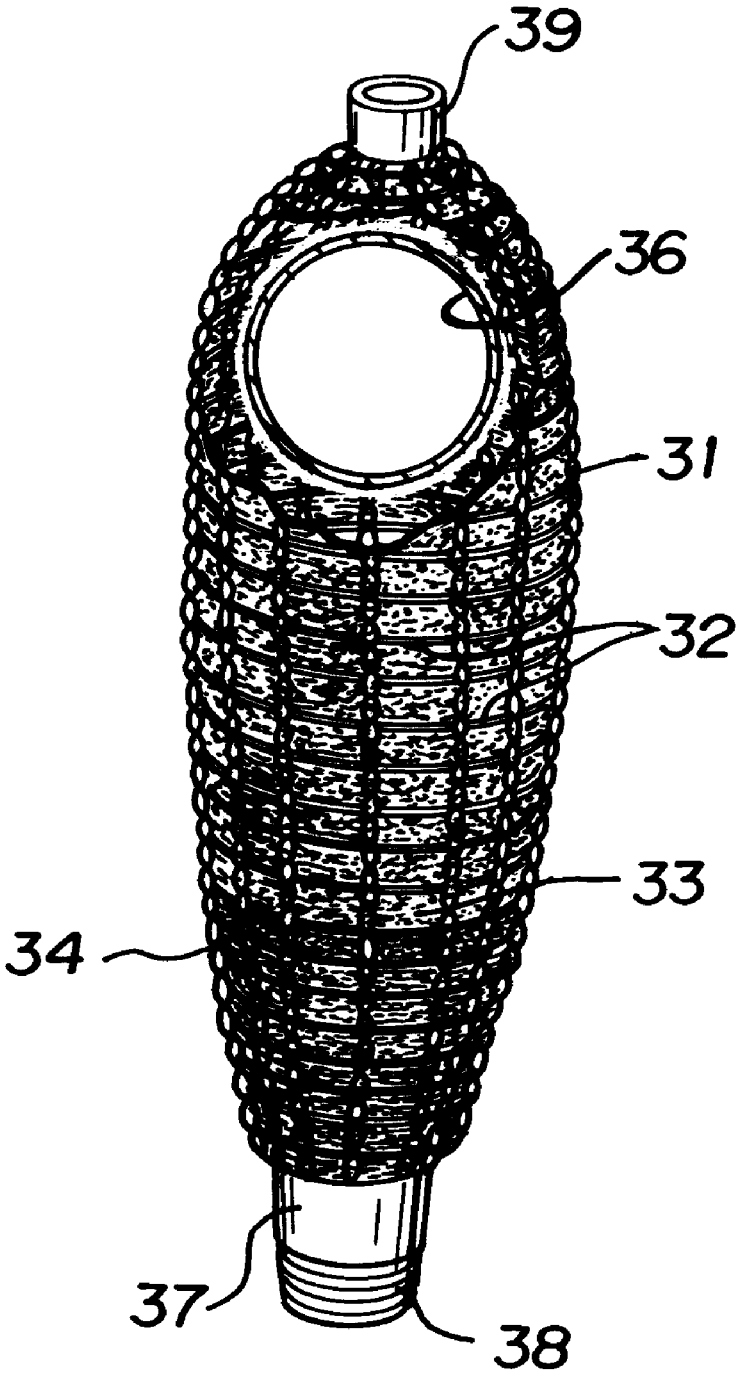
FIG. 3 is a perspective view of the bioreactor having the electret fibers of the invention as the active elements for sewage disposal as partially cut open.

Testing was undertaken for the effectiveness of the tourmaline-containing insolubilized polyvinyl alcohol fibers for promotion of sewage disposal. FIG. 3 of the accompanying drawing is a perspective view of the contact filtering unit to serve as a bioreactor prepared from the tourmaline-containing polyvinyl alcohol fibers as partially cut open. The body of the bioreactor has a basket-like cylindrical outer skeleton 34 consisting of a plural number of chain-knit yarns 31 longitudinally running in parallel and hoops 32 of a resilient monofilament connecting the longitudinal yarns 31. The mesh openings of the basket skeleton are densely filled with transversely running fibers 33 which are so fine as to ensure good contacting with the sewage water and deposition of the activated sludge bacteria. A float 36 of foamed polystyrene is contained inside of the basket skeleton 34 and prevented from running out of the cylindrical basket 34 by binding the upper ends of the respective longitudinal yarns 31 with an upper binder member 39 while the lower ends of the longitudinal yarns 31 are bound together with a tubular lower binder member 37 male-threaded in the lower end 38, by means of which as many as desired number of such bioreactors can be connected to a base table (not shown in FIG. 3) in sewage water to stand upright by the buoyancy of the float 36.

In the testing, the bioreactors were prepared from the formalized polyvinyl alcohol filaments and fibers containing 0.5% by weight of the tourmaline particles as prepared in Example 2 or from fibers and filaments of a conventional polypropylene resin containing no tourmaline particles.

Figure 4:
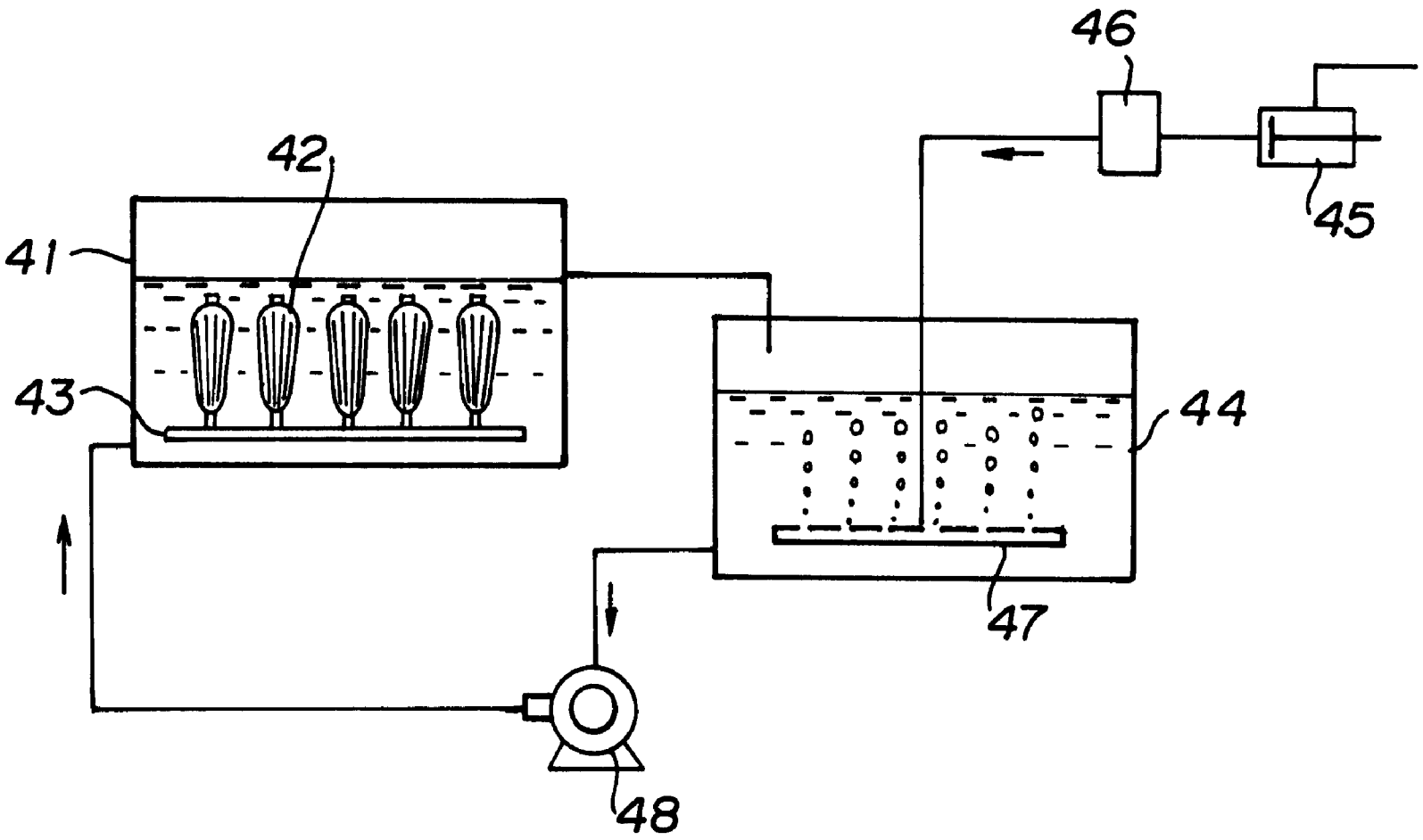
FIG. 4 is a schematic illustration of the sewage disposal system with several bioreactors illustrated in FIG. 3.

FIG. 4 is a schematic illustration of the experimental assembly used in the test of sewage disposal, in which the first sewage tank 41 was filled with 200 liters of sewage water having a BOD value of 4.6 mg/liter and a base table 43 was provided in the water, to which five bioreactors 42 were connectable, while the second sewage tank 44 was arranged to receive the overflow from the first sewage tank 41 and an air distributor 47 for aeration was installed in the water contained in the second sewage tank 44 to blow air from a compressor 45 in bubbles at a rate controlled by means of a regulator 46. The sewage water in the second sewage tank 44 after aeration could be recycled to the first sewage tank 41 by means of a pump 48.

With five bioreactors 42 made of tourmaline-containing polyvinyl alcohol fibers standing on the base table 43 under circulation of the sewage water between the first and second sewage tanks 41 and 44, a portion of the sewage water was taken from the first sewage tank 41 after 24 hours of running and analyzed to obtain a BOD value of 2.1 mg/liter with a 54.3% decrease.

For comparison, the same test as above was undertaken excepting for the replacements of the tourmaline-containing bioreactors 42 with similar but non-bioreactive contact filtering units made from conventional polypropylene fibers and filaments to find that the BOD of the sewage water was decreased from the initial value of 4.5 mg/liter to 3.9 mg/liter after 24 hours of running with a 13.3% decrease.

The above described experimental results support the presumption that the carbon- and nitrogen-containing organic contaminant materials in the sewage water can be decomposed and converted into carbon dioxide, nitrate nitrogens, nitrogen gas, water and the like when the sewage water is contacted with the tourmaline containing polyvinyl alcohol fibers which promote multiplication of the bacteria in activated sludges.

What is claimed is:

1. An electret fiber which is an insolubilized fiber of polyvinyl alcohol, containing particles of tourmaline having a particle diameter not exceeding 0.2 $\mu$m and an average particle diameter not exceeding 0.1 $\mu$m uniformly dispersed therein, wherein the amount of the particles of tourmaline is in the range of from 0.05 to 0.5% by weight based on the polyvinyl alcohol, and said fiber being insolubilized by formalization treatment of a polyvinyl alcohol fiber containing said particles, with formaldehyde.

2. The electret fiber as claimed in claim 1 in which the polyvinyl alcohol has a degree of saponification of at least 99% and has an average degree of polymerization in the range from 1000 to 2000.

3. An electret fiber which is an insolubilized fiber of polyvinyl alcohol, containing particles of tourmaline having a particle diameter not exceeding 0.2 $\mu$m and an average particle diameter not exceeding 0.1 $\mu$m uniformly dispersed therein, wherein the amount of the particles of tourmaline is in the range of from 0.05 to 0.5% by weight based on the polyvinyl alcohol, and said fiber being insolubilized by acetalization treatment of the polyvinyl alcohol fiber containing said particles, with glutaraldehyde.

4. The electret fiber as claimed in claim 3 in which the polyvinyl alcohol has a degree of saponification of at least 99% and has an average degree of polymerization in the range from 1000 to 2000.

* * * * *